United States Patent [19]

Hercog et al.

[11] Patent Number: 4,949,480

[45] Date of Patent: Aug. 21, 1990

[54] SKI BOOT

[75] Inventors: Milan Hercog, Graz; Axel Kubelka, Obdach, both of Austria

[73] Assignee: Kastinger Skiboot GmbH of Seewalchen, Austria

[21] Appl. No.: 303,521

[22] Filed: Jan. 27, 1989

[30] Foreign Application Priority Data

Jan. 28, 1988 [AT] Austria ..... A175/88

[51] Int. Cl.[5] ..... A43B 5/04

[52] U.S. Cl. ..... 36/119; 36/117

[58] Field of Search ..... 36/117–121, 36/50; 24/685 K

[56] References Cited

U.S. PATENT DOCUMENTS

| | | | |
|---|---|---|---|
| 4,654,985 | 4/1987 | Chalmers | 36/117 X |
| 4,658,517 | 4/1987 | Miyoshi et al. | 36/117 |
| 4,733,484 | 3/1988 | Delery | 36/120 |
| 4,823,485 | 4/1989 | Kemmer | 36/119 |

FOREIGN PATENT DOCUMENTS

| | | | |
|---|---|---|---|
| 230063 | 7/1987 | European Pat. Off. | 36/117 |
| 278281 | 8/1988 | European Pat. Off. | 36/117 |
| 3736931 | 6/1988 | Fed. Rep. of Germany | 36/117 |
| 668165 | 12/1988 | Switzerland | 36/117 |

*Primary Examiner*—David T. Fidei
*Assistant Examiner*—Andrew D. Meyers
*Attorney, Agent, or Firm*—Thomas R. Vigil; James P. Hanrath

[57] ABSTRACT

The ski boot comprises a shell upon a sole. The shell comprises a back heel portion, a shell tip and a front portion rearwardly extending from the shell tip to approximately an instep region. The front portion also has a longitudinal slot to divide part of the front portion into two shell flaps. A rear flap is pivotably mounted to the heel portion and a cuff is pivotably mounted to the shell portion, both the rear flap and cuff being capable of forward and backward movement. Structure is provided for closing the cuff in separable connection with the rear flap such that the cuff and rear flap when closed define at least part of a tubular shaft for a skiers leg. An outer wall above and at the sides of the front portion of the shell forms at least one chamber substantially sealed toward the outer surface of the outer wall and defined by the front portion at the bottom. The length of the outer wall is changeable depending on the pivotal movement of the cuff. The two shell flaps on the front portion of the shell can be drawn towards each other in a transverse direction by an adjusting mechanism.

38 Claims, 4 Drawing Sheets

SKI BOOT

A ski boot of this type, as disclosed e.g. by FR-A-2 553 634, comprises a rear flap and a cuff which are both pivotable. To be able to subject the instep portion of the foot to tension, an inner, movable pressure plate is provided which can be pressed backwards and downwards on the foot by means of a cable when the rear flap is pivoted forwards.

In known ski boots of this type problems are encountered in that area in which the lower, front edge of the pivotable cuff rests on the upper portion of the shell, such as in the instep portion. The forward movement of the cuff should be performed against a resilient, mostly also dampened resistance, which also depends on the friction between the cuff and the shell so that an adaptation of the shape of the shell surface to the pivotal movement is aimed at. Since such adaptation cannot be ideal for various reasons, also problems of sealing occur, i.e. snow or water may penetrate between the cuff and the shell down to the inner shoe.

To solve these problems it has been tried e.g. to provide, in the area of transition between the cuff and the shell, an outer strap fastened to the side of the shell which, on the one hand, serves sealing purposes and, on the other hand, serves to receive the forces. Another solution provides for a tongue which lies in the mentioned critical region between the shell and the cuff edge and then extends upwardly inside the cuff. A tongue positioned in such a manner likewise helps to seal and may also purposefully act as a resilient means like a kind of tube spring against the forward movement of the cuff or the tubular shaft, respectively. Since a sliding movement is possible between the cuff and the tongue and also between the tongue and the shell, respectively, the respective sliding surfaces may, by an appropriate design, be used to dampen the movement. In view of the extreme operating conditions with respect to temperature, moisture, etc. it is not possible, however, to achieve a defined resiliency or dampening, respectively, stable over a long period of time.

The object of the invention is to divide, in a ski boot with a rear flap and a cuff, the shell by a longitudinal slot into two flaps which can be drawn together and pressed against the foot by adjusting means. With such a ski boot the above-mentioned sealing problems become particularly acute because the shell has an opening in the instep portion because of the longitudinal slot.

The solution according to the invention offers the additional advantage that the adjusting means or part of that means, additional adjusting devices or resilient and dampening means, respectively, may be accomodated in the chamber, if necessary.

DESCRIPTION OF THE PREFERRED EMBODIMENT

Figure 1:
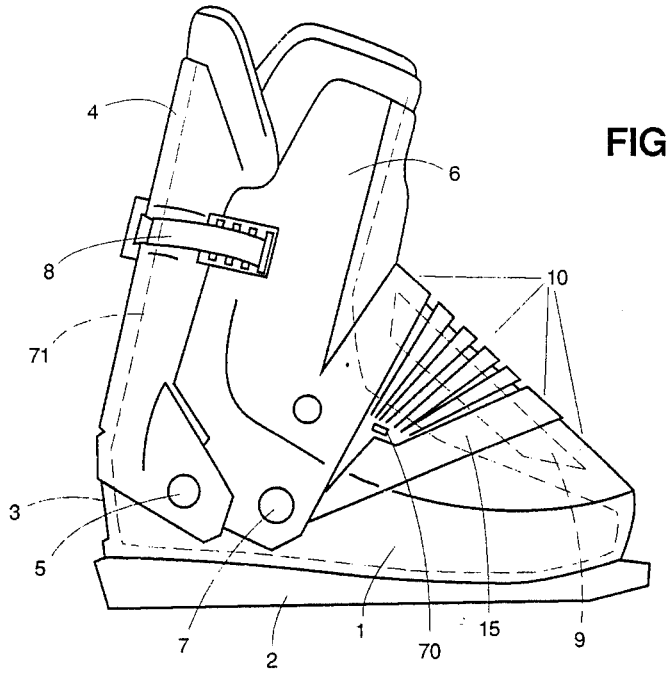
FIG. 1 is a side view of a skit boot constructed according to the teachings of the present invention.
Figure 2:
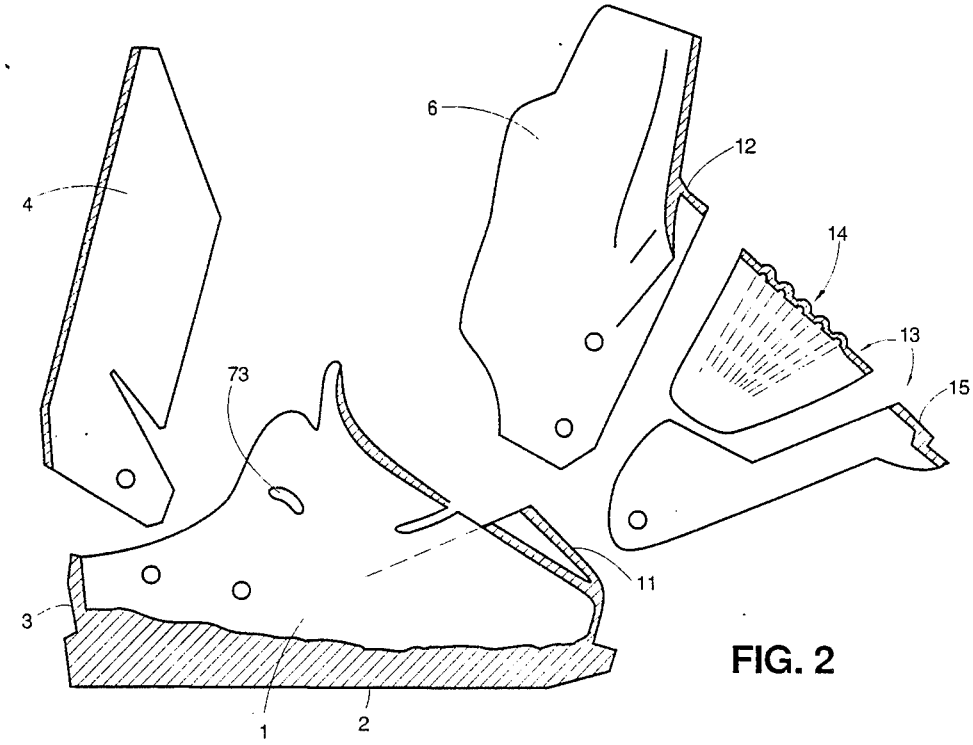
FIG. 2 is a partly sectioned, exploded side view of the essential parts of a ski boot constructed according to the teachings of the present invention.

FIGS. 1 and 2 disclose a ski boot according to the invention which comprises a shell 1 having a sole 2 and a raised heel portion 3 at the back. From the tip of the boot the shell 1 extends to approximately the instep region, preferably adapted to the shape of the foot. The ski boot further comprises a rear flap 4 which is pivotable forwards and backwards with respect to the shell and for this purpose is pivoted to the shell e.g. in pivot bearings 5 on both sides. Furthermore, a cuff 6 is provided which is likewise pivotable with respect to the shell and which, for this purpose, is pivoted to the shell in pivot bearings 7 on both sides with the flaps pulled down at the sides. The rear flap 4 may be separably connected with the cuff 6 by a closing means 8 which may, in a manner known per se, be e.g. a strap with a clasp, part of the rear flap 4 and of the cuff 6 forming at least a part of the tubular shaft which receives the skier's leg. In a known manner the rear flap 4 may be pivoted far backwards to permit comfortable entry into the boot. Since usually all the described parts are made of relatively hard plastics, an inner shoe 71 of soft flexible material is also provided, which lies between the skier's foot and the shell 1, the rear flap 4 and the cuff 6. As shown by the dotted lines in FIGS. 1 and 2 and e.g. also shown in FIG. 4, above and at the side of the front part of the foot, forming a chamber 9 substantially sealed towards the outside, an outer wall 10 is provided, whose length can be changed depending on the pivotal movement of the cuff 6 so that a certain forward and backward movement of the cuff 6 together with the rear flap 4 is possible. As shown in FIGS. 1 and 2, the outer wall 10 comprises e.g. a front wall portion 11—in the present case one piece—connected with the shell 1 in the region of the toes, a rear wall portion 12—here one piece—connected with the cuff 6, and a variable length intermediate portion 13. In the embodiment according to FIG. 2 the intermediate portion 13 comprises a variable length insert 14 and a holding clamp 15 which is pivoted with side flaps to the side of the shell, preferably together with the cuff 6, and which embraces in front and at the sides an edge portion of the variable length insert 14 which in the present case is shaped like bellows.

Figure 3:
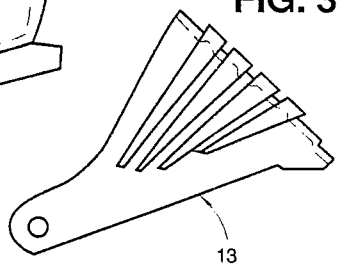
FIG. 3 is a side plan view of another embodiment of a variable length intermediate portion.

As shown in FIG. 3, the intermediate portion 13 may be without a holding clamp 15, however, there must be a possibility of changing the length to pivot the cuff 6, which is possible also e.g. by a bellow-type design, as shown in FIG. 3. In the embodiments according to FIGS. 1 to 3 elastically deformable bellows or bellows portion of the intermediate portion 13 is provided so that a pivotal forward movement of the leg and thus of the cuff 6 may be performed against the spring resistance produced in that way. A dampening of this resilient movement may be effected by an appropriate adaptation of the surfaces of the cuff and the shell, respectively, contacting each other, such an adaptation providing for a certain frictional force between these parts movable with respect to each other.

The formation of the chamber 9 by the outer wall 10 on the one hand results in a significant improvement of the torsion resistance of the ski boot without substantially increasing its weight, and on the other hand provides an aerodynamically functional shape. By varying the intermediate portion 13 with respect to its resilient and/or dampening properties the movement of the rear flap 4 and of the cuff 6 can be varied.

Figure 4:
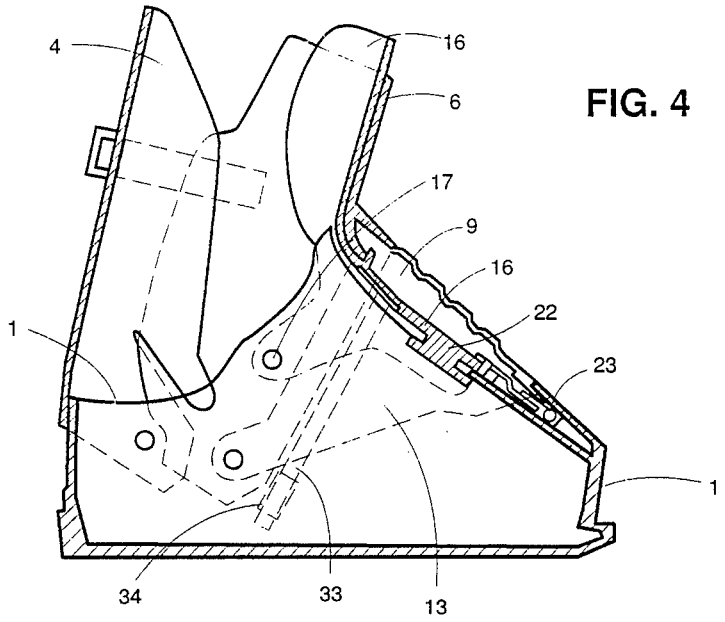
FIG. 4 is a schematic, partly sectioned side view of another embodiment of a ski boot constructed according to the teachings of the invention comprising a tongue.

The embodiment of the invention illustrated in FIG. 4 comprises a one-piece, partly bellow-type intermediate portion 13, similar to FIG. 3, the entire intermediate portion, just as in FIG. 3, being pivoted to the shell 1, together with the cuff 6, in lateral pivot bearings 7. In this embodiment also a tongue 16 is provided, which in this case is pivoted to the shell by means of two lateral flaps in pivot points 17 or lateral sliding slots 13 and thus may perform a certain pivotal movement. In the area of the instep the tongue 16 lies above the shell 1 and thus partly defines the chamber 9 to the bottom. In the region of the shell 1 covered by the tongue a longitudinal slot 18 is provided which borders on a transverse slot 19, the longitudinal slot 18 dividing the shell into two flaps 20 on both sides. Furthermore, the longitudinal slot 18 comprises an extension 21 extending forwardly, in which the front portion of the tongue 16 is slidably guided by means of a projection 22 broadened like a mushroom on its lower side, below the shell, and extending through this extension 21 of the longitudinal slot 18.

Adjusting means 23 only outlined in FIG. 4 may be provided for the tongue 16. According to FIG. 5 such adjusting means comprises a double threaded spindle 24 arranged in the frontmost portion of the chamber 9 and extending transversely to the boot, with one end of the spindle 24 extending outwardly through the chamber and being manually rotatable by means of a pivoted lever 25. On the threaded spindle 24 two nuts 26 are positioned, to which straps 27 are pivoted whose rear ends jointly engage the frontmost end of the tongue 16. It may be seen that by turning the spindle 24 by means of the lever 25, the two nuts 26 make a movement away from or towards each other so that the common connecting point of the two straps 27 and thus also the tongue 16 move forwards or backwards. In this way the initial tension of the tongue acting as a tube spring can be varied so that an adaptation of the resilient properties of the ski boot to different styles of skiing or different skills of the skiers is possible.

Figure 5:
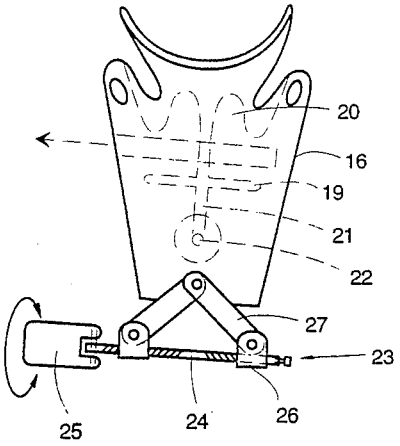
FIG. 5 is a schematic, partly sectional side view of another embodiment of the skit foot.
Figure 6:
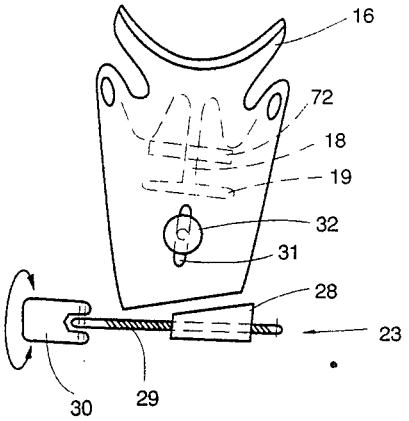

An alternative adjusting means for the tongue 16 is shown in FIG. 6. Here the forward movement of the tongue 16 is limited by a slidable wedge 28 which is positioned on a single thread spindle 29. The threaded spindle 29 may also be supported in the frontmost portion of the chamber 9 and one end thereof may extend outwardly so that, similarly as in FIG. 5, the threaded spindle 29 can be turned from outside by means of a lever 30 pivoted, to the free end. As shown, also the frontmost end of the tongue 16 can be wedge-shaped to effect good support on the wedge surface of the wedge 28. This wedge 28 thus constitutes a changeable front stop for the tongue 16, and by changing this stop likewise an adaptation to the skier's skills and/or the skiing conditions is possible. In this embodiment, the tongue is guided in a separate, short, longitudinal slot 31 of the shell by means of a rivet 32 or the like; the length of the slot 31 should be such that its front end constitutes a stop for the rivet 32 and thus for the tongue 16 when the tongue moves backwards.

Referring to FIG. 4 it shows that in the instep portion below the tongue 16 a tightening strap 33 extends over the two flaps 20 of the shell created by the longitudinal slot 18. This tightening strap 33 (cf. also FIG. 9) is fastened to the shell on one side, on the left side in the example shown, crosses the longitudinal slot 18 between the two flaps 20 and is guided through a slot in the outer wall (shown in FIG. 1) to a tightening means 34 positioned outside the boot. This tightening means 34 may be e.g. an adjustable clasp. Further embodiments of such a tightening means 34 are described in detail below by means of FIGS. 9, 10 and 11. To provide a good guidance of the tightening strap 33, a sunk guideway, e.g. a groove (shown in FIG. 6) may be provided in the shell 1 in the area of the two flaps 20. In this way the movement of the tongue 16 with respect to the shell 1 is not impeded either. It is evident that by means of the tightening strap 33 and the tightening means 34, respectively, the two flaps 20 of the shell 1 may be drawn together more or less in the instep portion so that an adaptation to different foot sizes and/or socks of different thicknesses and a more or less tight fit of the boot according to the skier's wishes can be achieved.

Figure 7:
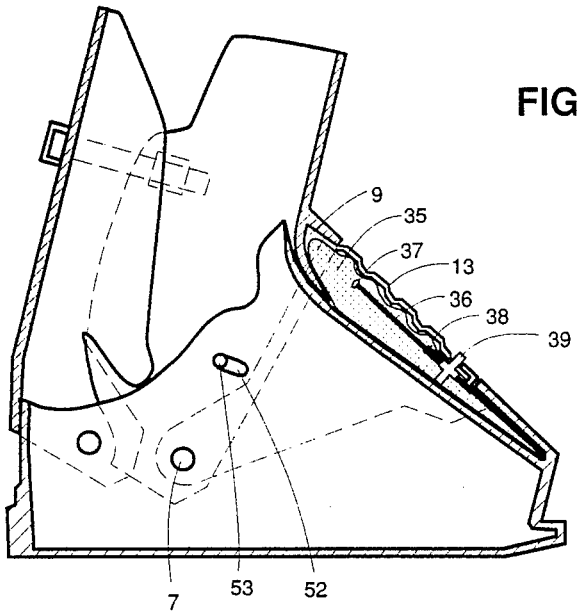
FIGS. 6 and 7 are schematic top views of two type of adjusting mechanisms for a tongue.

In the ski boot according to the invention illustrated in FIG. 7 a one-piece, bellow-type intermediate portion 13 is provided, similar as according to FIG. 3, which defines the chamber 9 towards the outside. In this embodiment an elastrically deformable body 35 is inserted into the chamber 9 which is made of e.g. polyester or polyether foam or a polyester-polyether foam mixture, respectively, or another cold-resistant foamed plastic and which has dampening properties. An adjusting rod 36 extends through a part of the chamber 9, which adjusting rod 36 rests with its front end on the foremost end of the chamber 9 and which comprises a transverse rod 37 or another broadening at its rear end. The length of the adjusting rod 36 can be varied by a nut 38 and a knurled wheel 39 which can be operated from outside, the socket-shaped nut 38 cooperating with appropriate opposed threads on the two parts of the adjusting rod 36. By turning the knurled wheel 39, the length of the adjusting rod 36 may be varied, resulting in a more or less strong compression of the foremost portion of the body 35 because the transverse rod 37 rests against this foremost portion of the body 35. This makes it possible to change the resilient and dampening properties of the body 35. However, such an additional influence on the body 35 is not absolutely necessary, rather, by a suitable choice of material and construction of the body 35 a wide range of resilient and dampening properties, respectively, acting on the movement of the cuff 6 may be covered so that the respective adaptation may be effected by the factory in a simple manner, the basic design of the ski boot staying the same. Of course provisions can be made that such an exchange of the body 35 is possible at a later date, e.g. by removable pivot bearings 7 and thus a temporarily removable intermediate portion 13 for exchanging the body 35.

Figure 8:
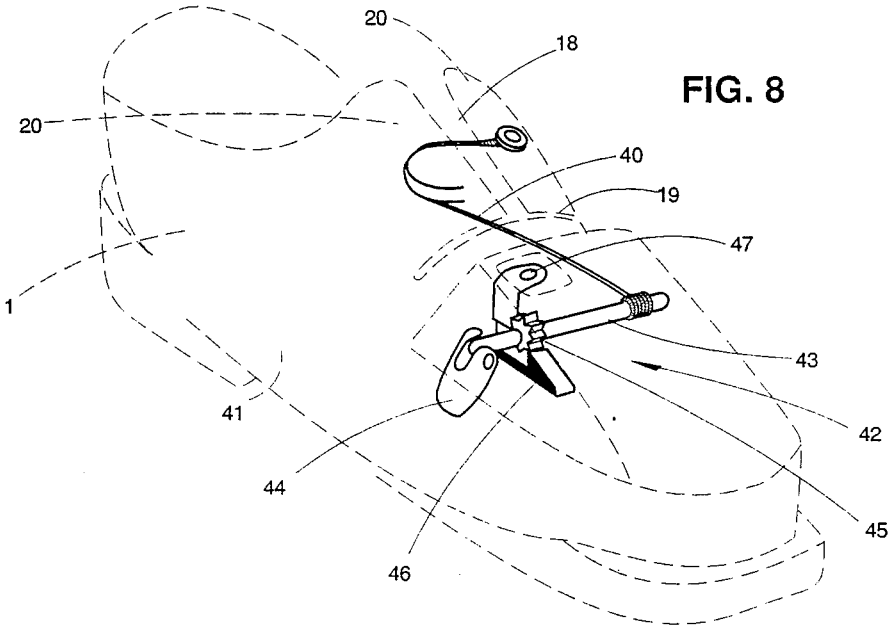
FIG. 8 is a schematic, perspective view of the shell of a ski boot constructed according to the teachings of the present invention with an appropriate adjusting mechanism.

FIG. 8 shows another possibility of adjusting the shell 1 in the region of the instep. In this embodiment, too, the shell 1 is divided into two flaps 20 by a longitudinal slot 18 and a transverse slot 19. One end of a wire rope 40 is fastened to one flap, in the present case to the left flap 20, e.g. by means of a rivet. The wire rope 40 is guided over a mushroom 41 at the other flap 20 or through an eyelet to a tension assembly 42. This tension assembly comprises e.g. a winding shaft 43 accomodated in the front portion of the chamber 9 and supported there, the one end of which being guided outwards through a bore to an operating lever 44. By means of this winding shaft the user can tighten the wire rope 40 more or less and thus achieve an approach or overlapping of the two flaps 20 of the shell 1. Turning the winding shaft in an opposite direction, on the other hand, results in a respective loosening as a result of of the elasticity of the shell. To fix the winding shaft 43, a ratchet wheel 45 engaged by a pawl 46 is mounted on the shaft. The pawl 46 can be released from outside by means of a key 47. The tension assembly 42 with the wire rope 40 thus serves the same purpose as the tightening means 34 in connection with the tightening strap 33 according to FIG. 4.

Figure 9:
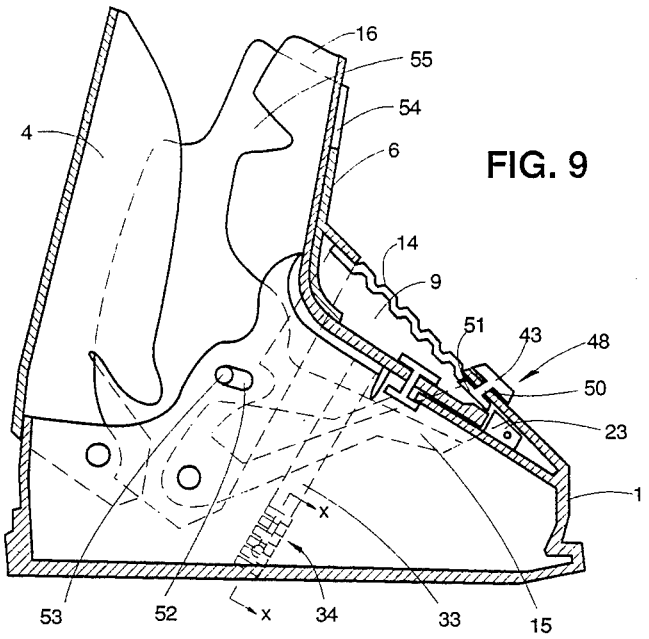
FIG. 9 is a schematic, sectioned side view of another embodiment of the ski boot of the present invention.

FIG. 9 shows a ski boot according to the invention having a tongue 16 with corresponding adjusting means 23, e.g. according to FIG. 5 or 6. The intermediate portion 13, just as in the embodiment according to FIG. 2, comprises an elastically deformable, bellow-type insert 14 and a holding clamp 15. On the upper side of the holding clamp an adjusting means 48 is provided which comprises a lever 49 positioned outside, which is connected via a shaft 50 with an eccentric disk 51 positioned inside. The eccentric disk 51 engages the front lower edge of the insert 14 so that by turning the lever 49 the initial tension of the bellows is adjustable by the user. Even if not shown, also in this embodiment the chamber 9 may be filled with an elastically deformable respectively dampening body 35. Like in the embodiments according to FIGS. 7 and 11, the forward and/or backward pivotal movement of the cuff 6 can be limited by a slot 52-pin 53-guide between the cuff 6 and the shell 1, the slot 52 usually being provided in the shell and the pin 53 at the cuff. Like the pivot bearings 5 and 7, these slot-pin guides 52, 53 are provided on both sides of the ski boot. FIG. 9 also shows a perpendicular slot 54 at the upper end of the cuff, which cooperates with the upper and outer surfaces of the tongue 16, a forward movement of the upper part of the tongue 16 with respect to the cuff 6 being possible, depending on the width and length of the slot 54. This movement is facilitated by lateral indents 55 in the upper portion of the tongue. Contrary to the embodiment according to FIG. 4, in which the tongue 16 is fastened with lateral flaps to the shell 1 in pivot points 17, the tongue 16 in the embodiment according to FIG. 9 does not have such lateral flaps for fastening, thus emphasizing its function as a tube spring.

Figure 10:
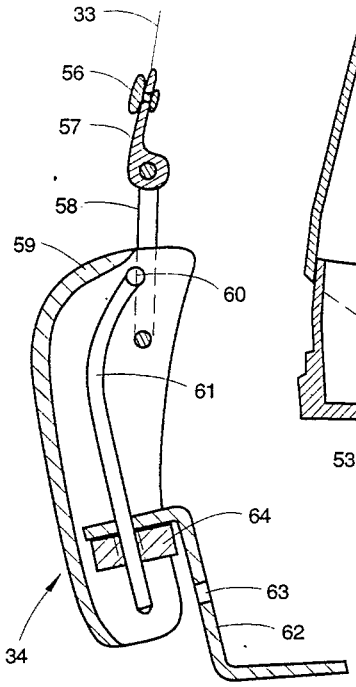
FIG. 10 is a sectional view taken along the line X—X of FIG. 9 and shows a possible embodiment of an adjusting clasp for the shell.

As in the embodiment according to FIG. 4, also in this embodiment a tightening strap 33 with a tightening means 34 is provided, said tightening means 34 being shown in detail in FIG. 10. The end of the tightening strap 33 is fastened, e.g. by means of a rivet 56, to one end piece 57. This end piece 57 is connected by means of a ring 58 with a hollow lever 59 which is open on one side, said ring 58 extending through e.g. the lateral surfaces of the lever 59 and being pivotally mounted both in the lever 59 and in the end piece 57. Above the bearing of the ring 58 a bolt 61 is supported in a shaft 60 which is positioned inside the lever when the lever 59 is closed and which is provided with a thread. An angle piece 62 extends through the lower, threaded end and can be fastened e.g. by means of rivets, screws or the like, in the sole portion of the boot. For this purpose bores 63 are provided in the central portion of the angle piece 62. In the direction of tightening the bolt 61 is held with respect to the angle piece 62 by means of a rotatable nut 64. It can be seen that by tilting the lever in the direction of the arrow A the tightening strap 33 may be loosened and thus the nut 64—which is now accessible—can be turned. By turning the nut 64 the desired tension of the strap 33 can be chosen and realized by tightening the lever 59 against the arrow A. The nut 64 may have such an outer surface that, when the lever 59 is closed, it cannot be turned so that the nut 64 is automatically secured against unintentional turning.

Figure 11:
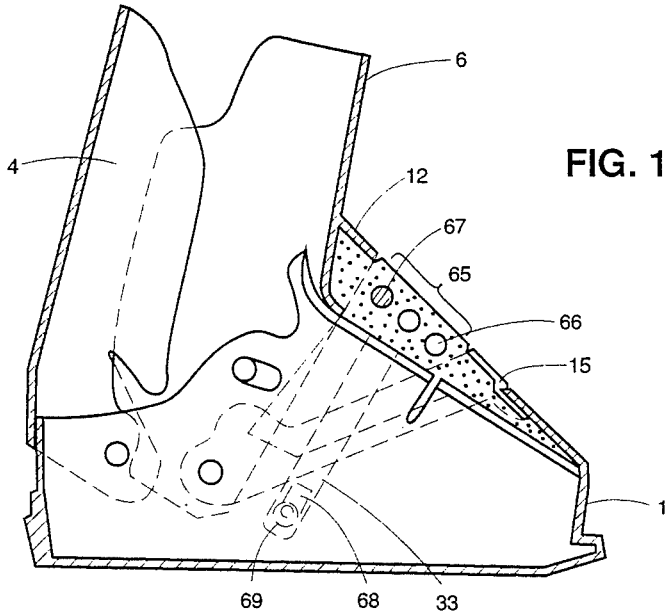
FIG. 11 is a schematic, sectional side view of another embodiment of a ski boot constructed according to the present invention.

FIG. 11 shows an embodiment which in principle is similar to that according to FIG. 9, but here the entire chamber 9 is filled with an elastically deformable body 35, the outer surface of that body forming a portion 65 of the outer wall which lies between the rear wall portion 12 integral with the cuff 6 and the outer surface of the holding clamp 15. The body 35 furthermore comprises one or several cylindrical transverse bores 66. By inserting inserts 67 into one or several of these transverse bores the resilient and/or dampening effect of the body 35 may be changed as desired if the inserts 67 are made of another material than the body 35. In general, the body 35 will be made of foamed plastics and the inserts 67 will be made of a relatively hard material compared with the former. FIG. 11 furthermore shows a simple tightening means for the tightening strap 33. For this purpose, an oval opening is formed in the end of the tightening strap 33 guided outwardly, which may be made e.g. of relatively hard, but flexible plastics, and an eccentric 69 is rotatably supported at the outer surface of the shell 1. The eccentric 69 extends through the opening 68 and may be adjusted by the user. The tension of the strap 33 can be changed by turning the eccentric 69 which is positioned at the lower end of the oval opening 68.

The examples described show that the outer wall of the intermediate portion 13 may be entirely or partly of the bellows type so that changes in length depending on the pivotal movement of the cuff are possible. However, it is also possible to provide a lamellalike or scalelike intermediate portion 13 or insert 14 which can then be telescoped. If in such a case the chamber 9 is hollow, the intermediate portion 13 or the insert 14, respectively, does not provide any additional resilient and/or dampening properties. However, in such a case, as already outlined above, the hollow space can be filled with a body 35 which has the respective properties. Depending on the desired requirements, a plurality of the shown adjusting or tightening means, respectively, can be combined in one single ski boot, thus offering a broad range of possible applications.

If a tongue 16 is used, it may also be pivoted to the shell 1, as shown in FIG. 4. But it may likewise be connected with the shell by a pin-slot guide so that the movement of the lateral portions of the tongue is limited. It is also worth mentioning that a shock absorber known per se, e.g. a gas pressure shock absorber, connected with the front portion of the shell 1, on the one hand, and with the cuff 6, on the other hand, may be accomodated in the chamber 9 provided according to the invention.

The term "outer wall" as used means that a cover is put around the shell 1 which forms the chamber 9, such cover consisting of one or several pieces. It does not exclude that this cover also comprises a lower wall bordering on the shell 1 and thus partly or entirely forms a capsule of its own in which the chamber 9 or parts of that chamber are accomodated.

We claim:

1. A ski boot comprising:

a shell upon a sole, preferably adapted to the shape of a foot, comprising a back heel portion, a shell tip, and a front portion rearwardly extending from said shell tip to approximately an instep region, said front portion having a longitudinal slot to divide part of said front portion into two shell flaps;

a rear flap pivotably mounted to said heel portion for forward and backward movement;

a cuff pivotably mounted to the shell for forward and backward movement;

means for closing said cuff in separable connection with said rear flap, said cuff and rear flap when closed defining at least part of a tubular shaft;

an outer wall above and at the sides of said front portion of the shell to form at least one chamber substantially sealed toward the outer surface of said outer wall and defined by the front portion at the bottom, the length of said outer wall being changeable depending on the pivotal movement of said cuff; and means for adjusting said two shell flaps in a transverse direction.

2. The ski boot as defined in claim 1 wherein said outer wall comprises a front wall portion connected with said shell in the region of the toes, a rear portion connected with said cuff, and a variable length intermediate portion.

3. The ski boot as defined in claim 2 wherein said variable length intermediate portion includes a holding clamp connected with said shell holding a variable length insert.

4. The ski boot as defined in claim 3 wherein said holding clamp is pivotably connected to both said shell and said cuff.

5. The ski boot as defined in claim 3 wherein said holding clamp embraces an edge portion of said variable length insert in front and at the side.

6. The ski boot as defined in claim 3 wherein said variable length insert comprises, at least in part, bellows deformable upon pivotal movement of said cuff.

7. The ski boot as defined in claim 1 wherein said variable length intermediate portion comprises, at least in part, bellows deformable upon pivotal movement of said cuff.

8. The ski boot as defined in claim 7 wherein said bellows are elastically deformable.

9. The ski boot as defined in claim 1 wherein said variable length intermediate portion is lamellalike or scalelike shifted into each other.

10. The ski boot as defined in claim 3 wherein said variable length insert is lamellalike or scalelike shifted into each other.

11. The ski boot as defined in claim 1 wherein said at least one chamber is at least partly filled with an elastically deformable body.

12. The ski boot as defined in claim 11 wherein the outer surface of said deformable body forms at least a part of the outer wall.

13. The ski boot as defined in claim 11 wherein said deformable body has dampening properties.

14. The ski boot as defined in claim 13 wherein said deformable body is made of a cold-resistant foamed plastic.

15. The ski boot of claim 14 wherein said foamed plastic is polyester.

16. The ski boot of claim 14 wherein said foamed plastic is polyether.

17. The ski boot of claim 14 wherein said foamed plastic is a polyester-polyether mixture.

18. The ski boot as defined in claim 13 wherein at least part of said deformable body contains a step adjustable by stop adjusting means in the direction of the pivotal movement of said cuff.

19. The ski boot according to claim 18 wherein said stop adjusting means comprises two threaded bolts moveable against each other by means of a threaded socket, one threaded bolt carrying at its free end said stop for said deformable body, and the other threaded bolt being supported or tied, respectively, with its free end to said shell or to said additional wall, respectively, and said threaded socket being rotatable from outside said boot by means of an outwardly projecting knurled wheel.

20. The ski boot according to claim 1 wherein said at least one chamber contains a shock absorber connected with said front portion of said shell and with said cuff.

21. The ski boot according to claim 20 wherein said shock absorber is a gas pressure shock absorber.

22. The ski boot according to claim 1 wherein part of the means for adjusting said two shell flaps is located in said chamber between said outer wall and said front portion of said shell.

23. The ski boot according to claim 1 wherein the means for adjusting said two shell flaps comprises a tension assembly having at least one wire rope fastened to one shell flap, guided either over a mushroom or through an eyelet of said other shell flap, and extended to fixed engagement with a rotatable winding shaft supported with said chamber, said winding shaft having an operating lever outside the boot and a ratchet wheel cooperating with a releasable pawl fastened to said shell or said outer wall to secure said winding shaft.

24. The ski boot according to claim 1 wherein the means for adjusting said two shell flaps comprises at least one tightening strap fastened to one shell flap, extended across the longitudinal slot between the two shell flaps, and guided through a slot in said outer wall to a tightening means positioned outside said boot.

25. The ski boot according to claim 24 wherein said tightening means comprises an adjustable clasp.

26. The ski boot according to claim 24 wherein said tightening means comprises a threaded spindle.

27. The ski boot according to claim 24 wherein said two shell flaps include a groove for a defined and sunk guideway of the tightening strap.

28. The ski boot according to claim 1 further comprising a tongue having side flaps pivotably mounted to said shell, preferably at pivot points above the pivot of said cuff on said shell, and means for adjusting said tongue forward or backward.

29. The ski boot according to claim 28 further comprising a changeable front stop adjustable by said means for adjusting said tongue.

30. The ski boot according to claim 28 wherein said means for adjusting said tongue comprises a double threaded spindle, arranged in the frontmost portion of the chamber, extending transversely to a pivoted lever outside the boot, said threaded spindle having two nuts, one on each thread, each nut pivoted to a strap, the rear end of each strap jointly engaging said tongue such that turning of the spindle by said lever causes the nuts to move away from or toward each other so that the common connection point of the two straps and the tongue moves forward or backwards.

31. The ski boot according to claim 28 wherein the means for adjusting said tongue comprises a slidable wedge positioned on a single thread spindle, arranged in the frontmost portion of said chamber, extending transversely to a pivoted lever outside the boot, said wedge having a wedge surface cooperating with a wedge shaped front end of said tongue to move said tongue forward or backward upon shifting of the wedge by the spindle.

32. The ski boot according to claim 29 wherein the front part of said tongue is slidably guided on said shell by means of a pin in a longitudinal hole.

33. The ski boot according to claim 29 wherein said tongue is pivoted by pins guided in lateral sliding slots of said shell.

34. The ski boot according to claim 1 wherein said front portion includes a transverse slot adjacent to the longitudinal slot to further define said two shell flaps.

35. The ski boot according to claim 1 wherein said front portion includes a transverse slot adjacent to the front end of the longitudinal slot to further define said two shell flaps.

36. The ski boot according to claim 1 further comprising an inner shoe made of soft, flexible material located between said shell, said rear flap and said cuff.

37. The ski boot according to claim 1 wherein the means for closing said cuff in separable connection with said rear flap comprises a strap with a clasp.

38. The ski boot according to claim 1 wherein said shell flaps are constructed, arranged and connected so that they do not overflap.

* * * * *